United States Patent [19]

McCurdy

[11] Patent Number: 4,980,671

[45] Date of Patent: Dec. 25, 1990

[54] REMOTE CONFINEMENT SYSTEM WITH TIMED TAMPER SIGNAL RESET

[75] Inventor: Jim A. McCurdy, Middletown, Ohio

[73] Assignee: Guardian Technologies, Inc., Cincinnati, Ohio

[21] Appl. No.: 343,814

[22] Filed: Apr. 26, 1989

[51] Int. Cl.[5] ..... G08B 23/00

[52] U.S. Cl. ..... 340/568; 340/539; 340/573; 379/38

[58] Field of Search ..... 340/568, 572, 573, 539, 340/652, 506, 507; 379/38, 49

[56] References Cited

U.S. PATENT DOCUMENTS

| | | | |
|---|---|---|---|
| 3,478,344 | 11/1969 | Schwitzgebel et al. | 340/312 |
| 3,618,067 | 11/1971 | De Vale et al. | 340/572 |
| 4,056,815 | 11/1977 | Anderson | 340/693 |
| 4,166,273 | 8/1979 | Riley, Jr. et al. | 340/539 |
| 4,223,830 | 9/1980 | Walton | 235/380 |
| 4,331,953 | 5/1982 | Blevins et al. | 340/539 |
| 4,598,272 | 7/1986 | Cox | 340/539 |
| 4,686,513 | 8/1987 | Farrar et al. | 340/572 |
| 4,736,196 | 4/1988 | McMahon et al. | 340/539 |
| 4,747,120 | 5/1988 | Foley | 379/38 |
| 4,777,478 | 10/1988 | Hirsch et al. | 340/568 |
| 4,792,796 | 12/1988 | Bradshaw et al. | 340/539 |
| 4,812,823 | 3/1989 | Dickerson | 340/572 |
| 4,843,377 | 6/1989 | Fuller et al. | 340/573 |

OTHER PUBLICATIONS

"Voicenet TM—The only electronic monitoring system you'll ever need", published by Vorec Corporation, Inc., 1988.

*Primary Examiner*—Joseph A. Orsino
*Assistant Examiner*—Geoff Sutcliffe
*Attorney, Agent, or Firm*—Wood, Herron & Evans

[57] ABSTRACT

A transmitter secured to the body of the confinee is provided with tamper detection means such as a conductive mounting strap, which if broken, sets a resettable electronic latch whose output determines the status of a tamper signal receivable by a remote station located within the confinement area. The latch is connected to a timer which serves to automatically reset the latch a first interval of time after it is initially set thereby eliminating the need for external reset equipment to carry out the reset operation. In order to avoid subterfuge, said first time interval is selected to be longer than any continuous interval of time the confinee is permitted to be absent from the confinement area. Information relating to the status of the tamper signal may also be relayed to a central monitoring station. To prevent transmission of a false tamper indication to the central station, the invention further contemplates inhibiting transmission of tamper indications to the central station in the event that less than a second interval of time, which is greater than said first interval, has elapsed since the occurrence of one or more predetermined events associated with normal operation of the system.

20 Claims, 7 Drawing Sheets

REMOTE CONFINEMENT SYSTEM WITH TIMED TAMPER SIGNAL RESET

FIELD OF THE INVENTION

The present invention relates to remote confinement systems of the type including a transmitter intended to be worn on the body of a person for monitoring the presence of the person within a remote confinement area defined by the range of the transmitter. More particularly, the present invention relates to such remote confinement systems wherein the transmitter transmits a message which includes a tamper indication signal which is activated upon removal of the transmitter from the body of the person and which is reset in response to the elapsing of an interval of time after the tamper signal is activated.

BACKGROUND OF THE INVENTION

The overcrowding of prisons and the high cost of their construction and operation have made urgent the need for effective and economical alternatives to institutional incarceration. Remote confinement systems which are sometimes referred to as "home arrest" or "home incarceration" systems have attracted a great deal of public interest in recent years as an aid for probation and as an alternative to prison or other institutional confinement for selected criminal offenders. A number of such systems are disclosed in the co-pending and commonly assigned U.S. Pat. application Ser. No. 07/041,698 entitled "Remote Confinement System", filed on Apr. 28, 1987 which is expressly incorporated herein by reference in its entirety. That application discloses systems for remotely monitoring the presence of an individual within a designated confinement area as well as for remotely determining the compliance of such a confined person with behavioral restrictions such as abstinence from use of substances such as alcohol and also for remotely verifying the identity of the individual.

In one typical type of remote confinement system, a central monitoring station is equipped with means for communicating with various remote confinement areas for the purpose of verifying the presence and optionally, the sobriety of confinees assigned to those areas. Such means may include provision for selectively establishing communications links with each remote confinement location according to a set or partially randomized schedule. For example, provision may be made for a host computer located at the central monitoring station and having access to schedule information to select from a data base the phone number of a specified confinee and to automatically dial that phone number via a modem connected to a conventional telephone network to initiate communication with the remote confinement area to which that confinee is assigned.

Upon answering the telephone, the confinee is audibly prompted to identify himself or herself using apparatus provided at the remote confinement area and optionally, to take a breath alcohol test, the results of which as well as identity information are transmitted to the central monitoring station. Upon receipt of this information at the central monitoring station such identity and/or sobriety information may either be stored for subsequent evaluation or subjected to immediate manual or automatic analysis to determine whether the designated confinee is present and complying with any applicable behavioral restrictions. Patent application Ser. No. 07/041,698 teaches various identity confirming techniques and behavioral condition testing devices which may be incorporated with advantage into such remote confinement systems.

It is also known in the prior art to monitor or supervise the behavior of individuals from a central station using a radio transmitter secured to or implanted within the body of such individuals. For example, U.S. Pat. No. 3,478,344 to Schwitzgebel discloses a behavioral supervision system wherein individuals to be monitored are equipped with a wrist-mounted oscillator and bodily carried transceiver unit. The oscillator causes the transmitter to generate a recognizably modulated radio signal in response to an interrogation signal generated by a second transceiver at the central station which includes means for determining the direction of the signal identifying the supervised person. The identifying oscillator is secured to the wrist of the supervised person by means of a band including an electrical connection which disconnects the oscillator if the band is attempted to be removed from the person of the confinee by cutting or breaking. Such tampering also throws a magnetic latching relay located inside the transceiver carried by the confinee which initiates transmission of a high-power, prioritized signal to the central station. Once the latching relay is set, it may be reset only by use of a specialized reset device which applies a strong magnetic pulse to the relay in order to reset it.

The need for such specialized reset devices causes great inconvenience and hampers economical operation of the remote confinement system. First, the reset devices themselves must be built or purchased and properly maintained thereby adding to the cost of the system. Also, when a tamper signal is received, the parole officer or other authorized personnel dispatched to the remote confinement area to check the integrity of the equipment worn by the confinee and reset the tamper signal must carry the special reset device with them. Unless all personnel who perform such work are provided with special reset devices and maintain them in proper working order, the parole officer closest to the confinee may not be able to reset the device. The officer would then have to travel to locate an operational reset device and return to carry out the reset function. This would not only impose additional manpower and travel expense but would also lengthen the time required to restore the system to full security operation.

SUMMARY OF THE INVENTION

In view of the foregoing problems, it is an objective of the present invention to provide a remote confinement system of the type including a transmitter intended to be worn on the body of a confinee for monitoring the presence of the confinee within a designated area and which provides means for detecting attempted removal of the transmitter from the confinee but does not require action by service personnel or the use of special external equipment to reset the tamper signal.

It is a further object of the present invention to provide such a system which assures that tamper events occurring even while the confinee is outside the designated confinement area will be reliably detected when the confinee re-enters the confinement area thereby avoiding undetected removal of the transmitter from the person of the confinee.

A transmitter secured to the body of a confinee and provided with tamper detection means such as a conductive mounting strap which, if broken, sets a resettable electronic latch whose output determines the status of a tamper signal which is transmitted to a remote station located within the confinement area. After verifying the validity of the tamper indication, the remote station relays the tamper information to a central monitoring station thereby bringing the tamper indication to the attention of supervisory personnel. According to the present invention, the electronic latch which responds to breakage of the mounting strap is connected to a timer which serves to automatically reset the latch in response to the elapsing of an interval of time after it is initially set. By so doing, the need for specialized external reset equipment is eliminated.

According to a second aspect of the present invention, the time interval for resetting the latch is selected to be longer than any continuous interval of time the confinee is permitted to be absent from the confinement area. This assures that should the confinee remove the transmitter from his or her person while the transmitter is out of range for communication between the transmitter and the remote station, the confinee could not then restore electrical continuity of the mounting strap and carry the transmitter back into the remote confinement area without the tamper condition being detected thereby permitting the confinee to subsequently leave the remote confinement area without his or her absence being detected.

Still further according to the invention, the timer which resets the tamper signal is itself initialized in response to the detection of tampering. This ensures that the tamper signal will persist for a predetermined time period sufficient to ensure that such tampering will be detected.

It is yet another object of the invention to avoid reception of false tamper indications by a central monitoring station. A remote station locatable within the confinement area for receiving tamper indications from the transmitter worn by the confinee communicates with the central monitoring station which may include a host computer. According to the invention, when the remote station receives a tamper indication from the transmitter, transmission of such tamper information from the remote station to the central station is inhibited unless at least a second interval of time has elapsed. This second interval, which is longer than the time interval at which the tamper signal is to be reset, commences with the occurrence of one or more predetermined events such as the application of power to components of the remote station or the receipt of instructions from the central monitoring station to recognize only signals generated by a different transmitter from that previously recognized. Such events, while associated with normal system operation, are prone to generate "false" tamper indications which the invention thus prevents from being transmitted to the central monitoring station.

These and other objects and advantages of the invention will be readily apparent to those skilled in the art from the following detailed description of a preferred embodiment of the invention and from the accompanying drawings wherein like reference numerals designate like items.

DETAILED DESCRIPTION OF THE PREFERRED EMBODIMENT

Figure 1:
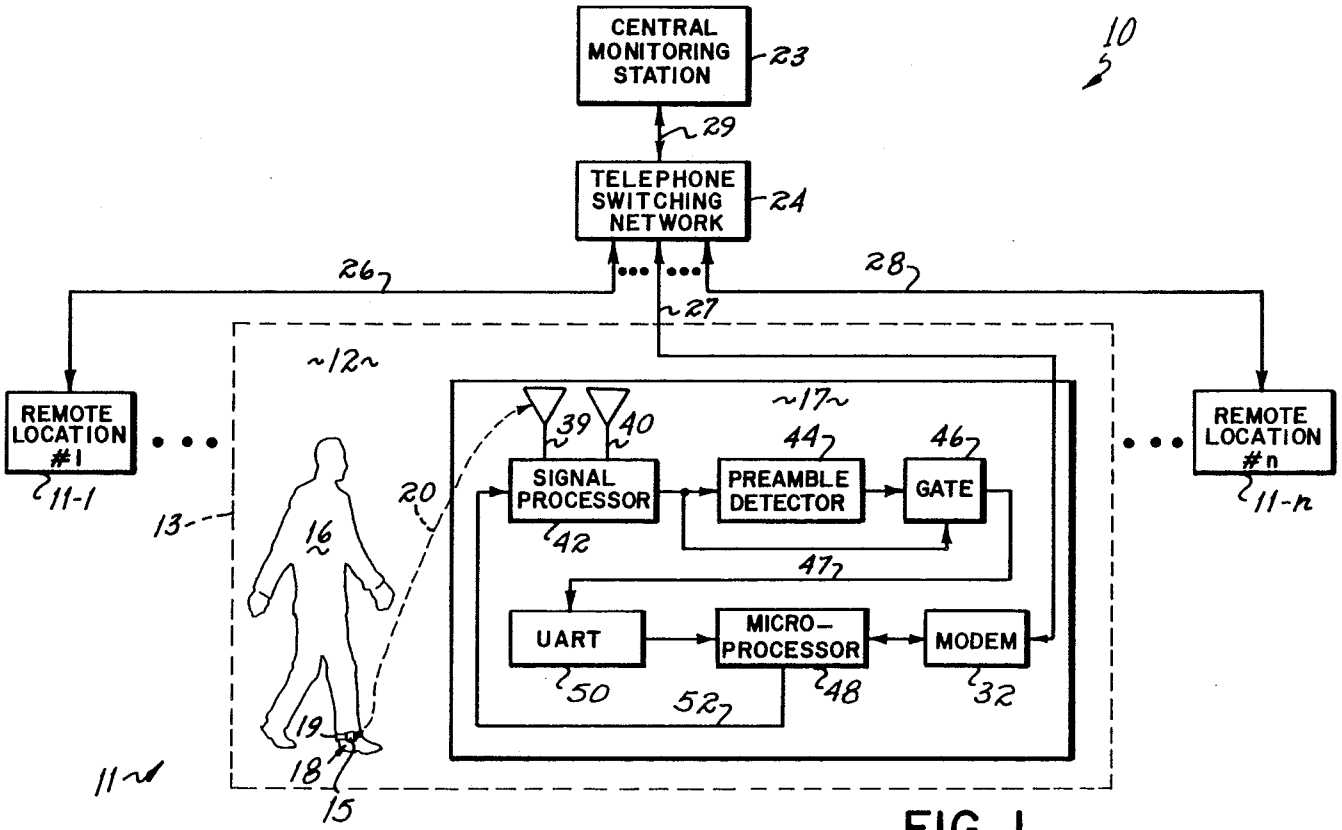
FIG. 1 is a schematic block diagram of a remote confinement system incorporating the present invention.

FIG. 1 shows a remote confinement system 10 which includes a plurality of remote confinement locations 11-1 through **11-*n* representing homes or other designated remote confinement locations to which confinees are assigned or sentenced in a home incarceration program. A typical such remote location 11 includes a confinement area 12 whose boundary 13 is defined by the range of communication between a transmitter 15 physically associated with the body of a confinee 16 and a remote station 17. Transmitter 15 may conveniently be housed within an anklet 18 intended to be secured to the body of confinee 16 for the duration of his or her confinement by means of an anklet mounting strap 19. Transmitter 15 generates radio frequency telemetry 20 which is received by remote station 17 to indicate the confinee's 16 presence within or absence from confinement area 12**.

In the event confinee 16 strays beyond the boundary 13 of area 12 so that transmitter 15 is no longer within communication range of remote station 17, remote station 17 will not receive telemetry 20 thereby indicating the absence of confinee 16 from his or her designated confinement area 12. Information concerning the presence of confinee 16 within or the absence of confinee from area 12 is made available to supervisory personnel through a host computer located at a central monitoring station 23 which may take a number of forms such as those described in copending commonly assigned U.S. Pat. Application Ser. No. Ser. No. 07/343,860 entitled "Remote Confinement System", filed in the name of Williamson et al. on even date herewith and which is expressly incorporated herein by reference in its entirety. Communication between remote station 17 and monitoring station 23 is carried out by way of a communications link which may suitably comprise a conventional telephone switching network 24 through which central monitoring station 23 may communicate bidirectionally with each remote confinement location 11-1 through **11-*n* (including typical location 11) over telephone lines 26, 27, 28 and 29**.

Remote station 17 includes at least one and preferably two antennas 39, 40 connected to a signal processor 42 which receives and interprets telemetry 20 received from the anklet 18 worn by confinee 16. Telemetry 20 preferably includes a preamble message recognizable by a preamble detector 44 which will be described in further detail with reference to FIG. 6. Assuming the correct preamble is detected, preamble detector 44 transmits an enable signal to a gate 46 which generates an output signal 47 to permit digital data derived from telemetry 20 to be transmitted to a microprocessor 48 by way of a UART 50. In the event microprocessor 48 fails to receive telemetry 20 properly, it may optionally generate an antenna switching signal 52 to switch the active antenna 39 or 40 to the other one of those antennas from that which was previously active. This optional feature improves system reliability by avoiding false absence indications due to possible irregularities in the reception pattern of antennas 39 and 40. Microprocessor 48 interprets the information received from UART 50 and, via modem 32, transmits information indicating the presence or absence of confinee 16 to central monitoring station 23.

From the foregoing description it can be appreciated that reliable indication of the presence or absence of confinee 16 depends on assuring that the transmitter 15 generating telemetry 20 is physically associated with the body of the confinee 16. This may be accomplished in a number of ways including the surgical implantation of transmitter 15 or its securement to the outside of the body of confinee 16. The latter technique is readily carried out by housing transmitter 15 within an anklet the mechanical structure of which is illustrated in FIG. 2.

Figure 2:
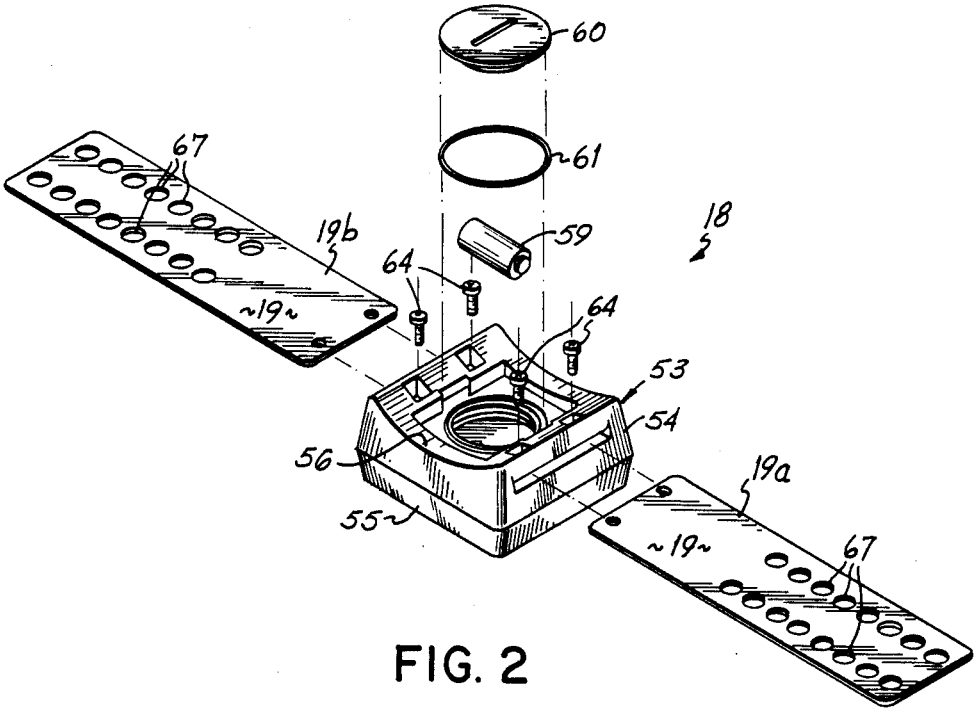
FIG. 2 is a partially exploded view of the anklet shown in FIG. 1.

Referring now to FIG. 2, anklet 18 includes a durable waterproof housing 53 which may conveniently be formed by injection molding a tough, impact resistant plastic material to form a chassis 54 and a mating cover 55. For comfort, housing 53 preferably includes a contoured portion 56 conforming at least approximately to the exterior body surface adjacent to which anklet 18 is to be worn. Anklet 18 houses electronic components (not shown in FIG. 2) which will be described in further detail with reference to FIG. 5. These are powered by a long life lithium battery 59 which is inserted into housing 53 from its body contacting side and water tightly secured therein by means of a threaded cover 60 and a sealing O-ring 61.

Secured to housing 53 via fasteners 64 is anklet mounting strap 19. To facilitate detection of tampering by removal of anklet 18 from the person of confinee 16, strap 19 preferably includes an electrical conductor, the breakage of which due to tampering can be electronically sensed. Conveniently, strap 19 may be formed of an electrically conductive flexible plastic material. One suitable such material is a conductive olefinic thermoplastic elastomer available under the designation 2899X 53675F from R.T.P. Company of Winona, Minnesota. Strap 19 may conveniently be formed in two halves **19*a* and 19*b* each of which includes a plurality of mounting holes 67 formed at spaced intervals along their length so that strap 19 may be fitted for snug securement to the body of confinee 16**.

Figure 3:
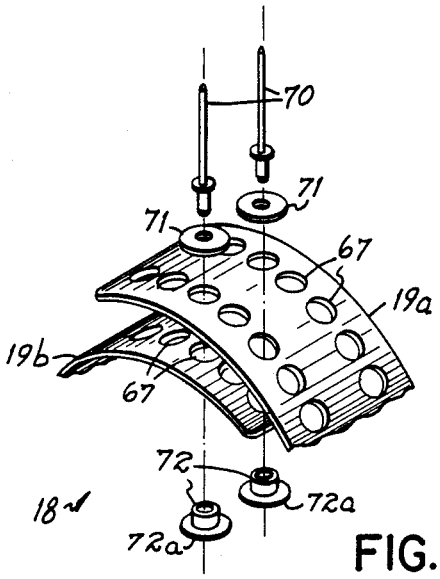
FIG. 3 is a partial perspective view illustrating the securement of the anklet mounting strap shown in FIG. 2.

Referring additionally now to FIG. 3 the mounting of anklet 18 will now be described. This is accomplished simply by wrapping the halves **19*a* and 19*b* of strap 66 above the ankle of confinee 16 and securing half 19*a* to half 19*b* by means of blind rivets 70 which pass through washers 71 adjacent strap half 19*a* as well as through bushings 72 having flanges 72*a* engaging the body side of strap half 19*b*. Of course, any alternative method which ensures both electrical continuity and secure mechanical connection of strap 19 may be used. Subsequent to its securement to the person of confinee 16, any loss in electrical continuity of strap 19 can be used to detect tampering such as attempts to remove transmitter 15 from the body of confinee 16** in the manner to be described below.

Figure 4:
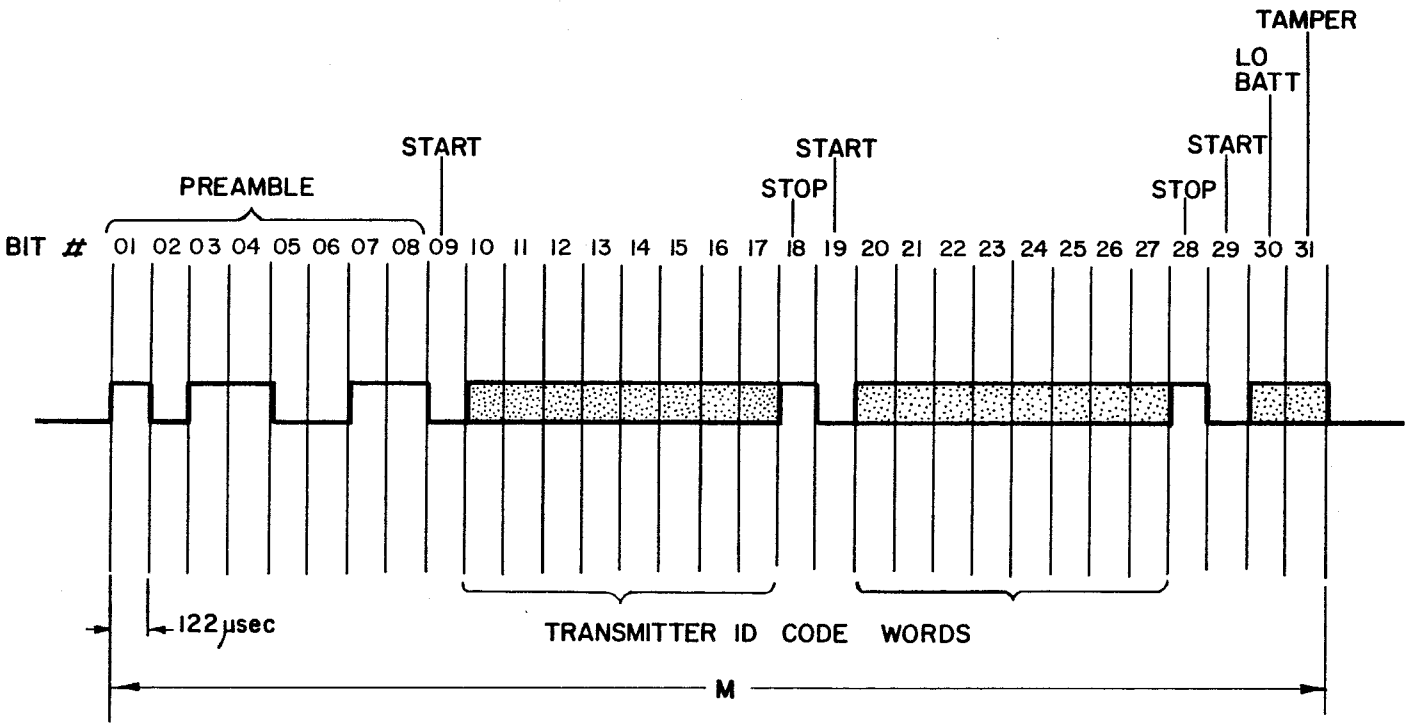
FIG. 4 is a diagram illustrating the telemetry generated by the anklet shown in FIG. 1.

Referring additionally now to FIG. 4, the telemetry 20 associated with transmitter 15 will now be described. While such telemetry may be transmitted continuously, battery 59 is conserved and therefore service requirements are reduced if transmitter 15 transmits on a periodic basis a multi-bit message M that is brief in relation to the time interval between transmissions. In a preferred embodiment, message M consists of a stream of thirty-one consecutive bits each bit having a nominal duration of 122 microseconds. As referred to herein, each bit of message M is numbered consecutively 01 through 31, respectively. Preferably, message M commences with a multi-bit preamble consisting of an arbitrary string of digital information which serves to identify message M as valid telemetry 20 emanating from a transmitter 15 as well as to assist in formatting the remainder of message M for processing by UART 50. For example, an 8 bit preamble with bits #01 through #08, respectively set at 10110011 may be used. The end of the preamble is indicated by a "START" bit, bit #09.

In order to be able to ensure that the telemetry 20 being received indicates the presence of a particular individual confinee 16, the preamble of message M is preferably followed by a two word transmitter identification code the first 8 bits of which bit #s 10 through 17 are proceeded by a "start" bit, bit #09 and followed by a "stop" bit, bit #18. Likewise, the second word of the transmitter identification code, bit #s 20 through 27 are preceded by a "start" bit, bit #19 and followed by a "stop" bit, bit #28. Even if telemetry 20 includes the correct preamble, a designated confinee 16 will not be assumed to be present within his or her designated confinement area 12 unless microprocessor 48 determines that telemetry 20 includes the particular transmitter identification code assigned to a particular remote station 17. Via modem 32, remote station 17 may receive instructions from central monitoring station 23 to recognize a different transmitter identification code from that previously recognized.

Following the transmission of "stop" bit #28, a "start" bit, bit #29 indicates transmission of a pair of status bits, Bit #s 30 and 31. Bit #30, designated "LO BATT" assumes a predetermined logical state in the event that the voltage of battery 59 falls below a predetermined threshold to indicate that battery 59 must be changed. Bit #31, which is designated as the "TAMPER" indication bit assumes a predetermined logical state in the event that tampering, as indicated by an interruption in the electrical continuity of strap 19, is detected.

Figure 5A:
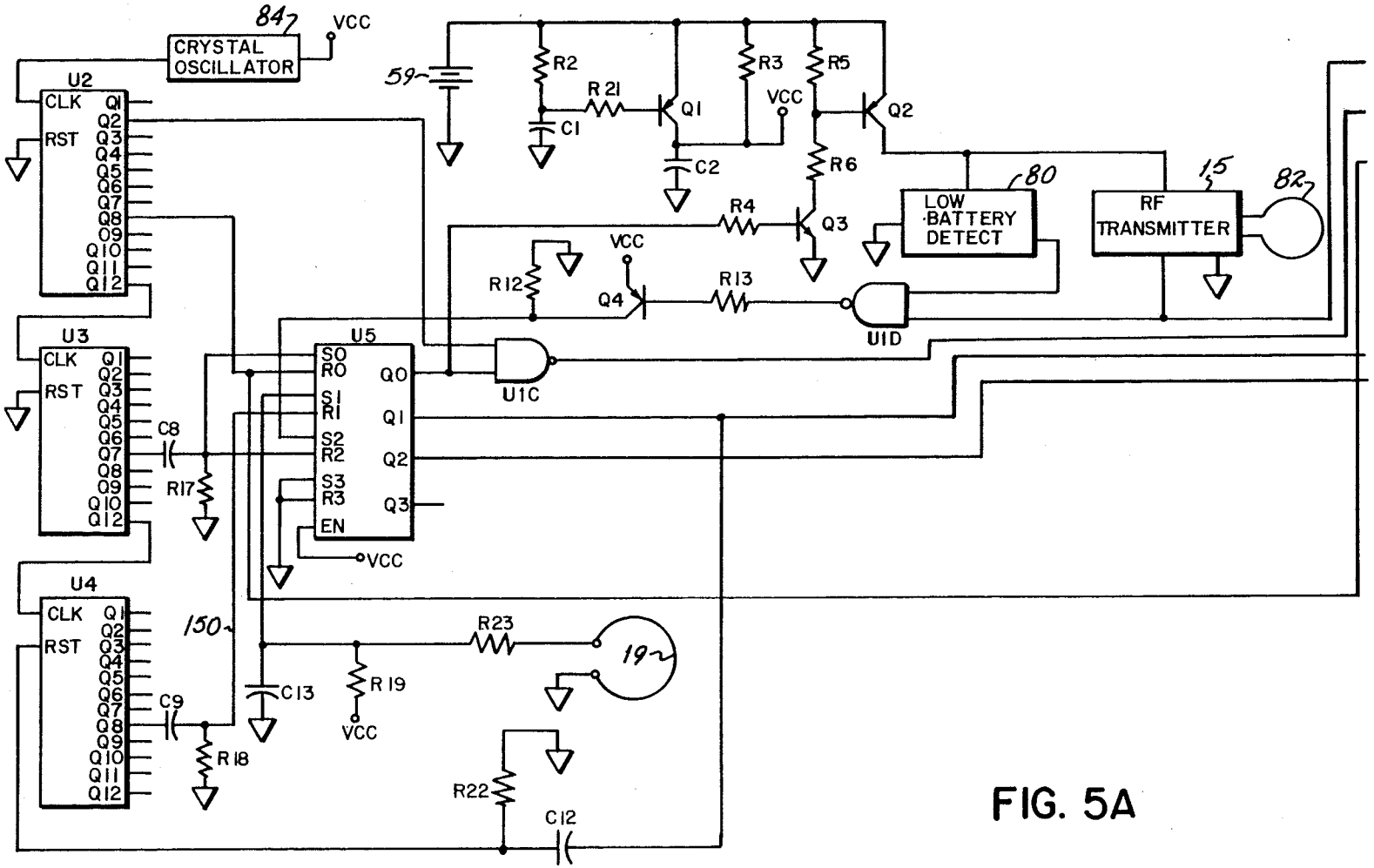
FIGS. 5A and 5B together comprise a combined electrical schematic and block diagram of the anklet of FIG. 1.
Figure 5B:
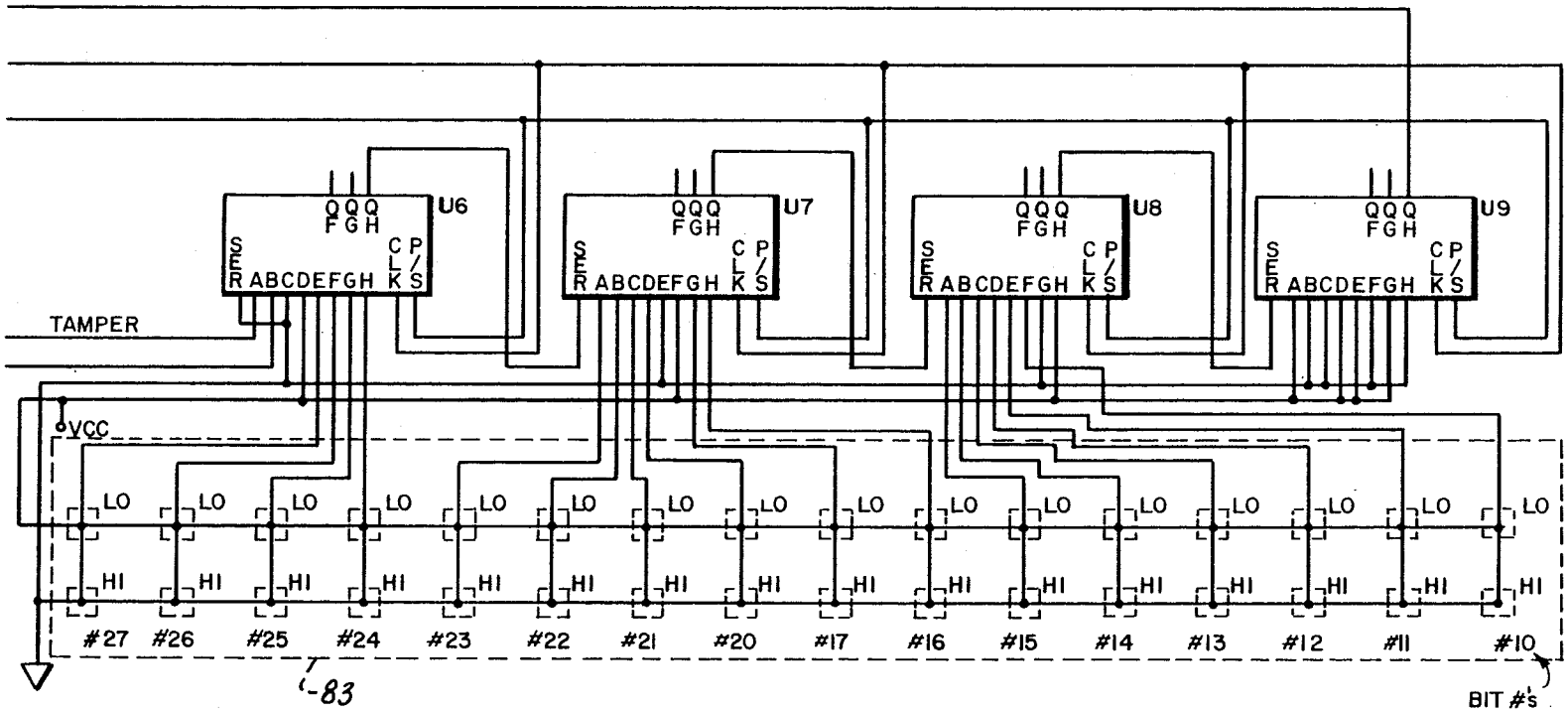

Referring now to FIG. 5, the electronic components of anklet 18 will now be described in further detail. Anklet 18 is powered by battery 59 to which a transistor Q1 and associated resistors R2, R3, R21 as well as capacitors C1 and C2 are connected to develop power supply VCC as shown. Battery 59 is also connected by way of a pair of switching transistors, Q2 and Q3, to control the application of power to a low battery detection circuit 80 as well as RF transmitter 15 the latter of which is connected to a loop antenna 82 for transmitting telemetry 20.

The content of message M is determined by a series of shift registers U6, U7, U8 and U9 connected as shown. Shift registers U6 through U9 may suitably comprise an 8-bit static shift register such as type 4021 manufactured by Motorola Semiconductor Products, Inc. of Phoenix, Arizona or equivalent. The bit sequences of the transmitter identification code words are determined by the jumpering of a header 83 to strap any of bit #s 10 through 17 and 20 through 27 either HI or LO to ground or VCC, respectively in accordance with an arbitrary transmitter identification code corresponding to a particular anklet. Similarly, the preamble described above with reference to FIG. 4 is defined by strapping pins A through G of U9 and pin H of U8 to VCC or ground in the manner shown. "Stop" bit #s 18 and 28, respectively are developed by strapping to VCC pin F of U7 and pin D of U6, respectively while "start" bit #s 09, 19 and 29 are developed by strapping to ground pin G of U8, pin E of U7 and pin C of U6, respectively. LO BATT, bit #30, is determined according to the logical status of pin B of U6. Pin B of U6 is connected to the output Q2 of a three state R/S latch quad U5 which may suitably comprise a type such as part number 4043 manufactured by Motorola Semiconductor Products, Inc. of Phoenix, Arizona or equivalent. The Q2 output of latch U5 is set by a signal appearing at pin S2 of U5 which is connected to the emitter of a transistor, Q4, whose base is connected to the output of a NAND gate U1D one input of which is connected to the output of low battery detection circuit 80 and the other input of which is connected to pin 3 of U9 which carries that portion of message M to be transmitted by transmitter 15. Thus, whenever low battery detection circuit 80 indicates that the voltage of battery 59 is unacceptably low, and a transmission is occurring, pin B of U6 will assume a logical status indicating a low battery voltage condition.

With continued reference to FIG. 5 and considering the generation of message M in further detail, it can be seen that anklet 18 includes a crystal oscillator 84 the output of which is frequency divided by a series of serially connected 12 bit counters U2, U3 and U4 connected as shown to form a timer. U2, U3 and U4 may suitably comprise a 12 stage ripple carry binary counter/divider such as a part number 4040 manufactured by Motorola Semiconductor Products, Inc. of Phoenix, Arizona or equivalent. In a preferred embodiment, crystal oscillator 84 operates at a frequency of 32.768 KHz. As a result, output Q2 of counter U2 undergoes a positive transition about once each 122 microseconds which determines the duration of each bit of message M. That signal is applied to gate U1C whose output is connected to the clock input of each of registers U6, U7, U8 and U9. Gate U1C is enabled by a signal appearing at the output Q0 of latch U5 which signal is set in response to a pulse applied via a capacitor C8 and R17 resistor connected to the Q7 output of U3. That pulse is generated in response to a signal appearing approximately once each 16 seconds at the output Q7 of counter U3. The Q0 output of latch U5 is also applied to the base of a transistor Q3 via a resistor R4 to turn on transistor Q2 thereby periodically energizing both low battery detection circuit 80 and RF transmitter 15 for a time period sufficient to allow transmission of message M. That time period, which in one preferred embodiment is approximately 4 milliseconds, is determined by the Q8 output of counter U2 which is applied to the R0 input of latch U5 to reset Q0 thereby deenergizing low battery detection circuit 80 and RF transmitter 15 after telemetry 20 has been transmitted to conserve battery 59.

Considering now the setting of "TAMPER" bit #31 and with continuing reference to FIG. 5, it can be seen that the conductive strap 19 which secures anklet 18 to the body of confinee 16 is connected between power supply VCC and ground through a resistor R23 and a pull-up resistor R19. R23 and R19 are each connected to a capacitor C13 which serves to filter out any transient signals appearing across R19. Normally, while strap 19 is electrically continuous, the voltage across C13 is substantially zero. However, in the event of tampering resulting in a loss of electrical continuity through strap 19 due to breakage or cutting thereof, the voltage across capacitor C13 is pulled to VCC by resistor R19. As a result, the S1 input of latch U5 is activated and the Q1 output of U5 is set so that pin A of U6 assumes a logical "HI" value indicating the existence of a tamper condition which will be brought to the attention of personnel at the central monitoring station 23 after telemetry 20 has been received at remote station 17.

According to the present invention, TAMPER bit #31 is automatically reset after being present for a sufficient length of time to permit reliable detection of the tamper condition at central monitoring station 23. Preferably, such resetting is carried out by means of a periodic signal generated by a timer. In the preferred embodiment described, such a reset signal 150 is conveniently generated by counter U4 whose output Q8 is connected to a capacitor C9 and resistor R18 connected between the Q8 output of counter U4 and the R1 input of latch U5 as shown. Capacitor C9 and resistor R18 serve to transform the signal formed due to a change in the state of output Q8 of U4 into a momentary pulse which appears periodically at regular time intervals. By generating such a tamper reset signal, such as signal 150, at spaced intervals in time separated by sufficient time to permit reliable detection of any tamper condition which may occur, the need for specialized external equipment to carry out the resetting operation is eliminated.

According to a second aspect of the invention, the time interval during which the tamper bit appearing at the Q1 output of quad RS flip flop U5 remains set prior to being reset is selected to be longer than any continuous interval of time the confinee is permitted to be absent from confinement area 12. For example, the sentence to which confinee 16 is subjected may permit him or her to be absent from confinement area 12 for designated time intervals such as 8 or 9 hours to permit confinee to hold a job or to obtain counselling or other rehabilitation. To do so, the confinee may need to be present at a location located well beyond the boundary 13 of remote confinement area 12. While such periods of absence may be permissible or even desirable to facilitate rehabilitation of confinee 16 while minimizing the burden of his or her confinement to society, they may be viewed by the confinee as an opportunity for subterfuge.

In particular, while confinee 16 is absent from remote confinement area 12, he or she might remove transmitter 15 from his or her person by cutting or breaking the mounting strap 19 of anklet 18. The confinee might then attempt to defeat the system by restoring the electrical continuity of strap 19 and carrying anklet 18 with its reconnected mounting strap back into remote confinement area 12 within the schedule permitted. The confinee might then attempt to leave the transmitter 15 inside area 12 to falsely indicate the presence of the confinee there while the confinee roamed outside area 12 without detection.

To avoid this situation, it has been known to provide a magnetic latching relay which is set upon removal of transmitter 15 from the person of the confinee. Such a relay would remain set even after subsequent reconnection of tamper detection means such as a conductive mounting strap so that the tamper condition would be detected immediately upon the reentry of transmitter 15 to area 12. However, in order to reset the latch to restore normal operation it has heretofore been necessary to reset the tamper detection latch using specialized external reset equipment. As can be appreciated from the foregoing, the need for such equipment is completely eliminated by the present invention which automatically applies reset signal 150 to pin R1 of latch U5 in order to reset the tamper indication on a periodic basis.

According to a second aspect of the present invention the reset interval is selected to be a period of time long enough with respect to any period of time during which the confinee 16 is permitted to be absent from remote confinement area 12 to assure that the tamper bit will not be reset for at least sometime after the confinee is required to reenter confinement area 12 according to the schedule required by his or her sentence. For example, assuming confinee 16 is permitted to be absent for a designated nine hour period during each work day, the reset time period is selected to be a time significantly longer than such 9 hour period. For example, in the preferred embodiment described, a reset pulse 150 is applied approximately once every 18 hours. In this way, should confinee 16 tamper with anklet 18 while outside confinement area 12 it is assured that TAMPER bit #31 will remain set and will not be reset for a period of time after the confinee is required to return to area 12 thereby facilitating reliable detection of the tamper condition. In order to ensure that the tamper indication will persist for the full 18 hours (or other time period selected in accordance with the confinement schedule of confinee 16 to ensure reliable detection of the tamper condition), counter U4 is initialized in response to the occurrence of a tamper event. This is conveniently accomplished by connecting the RST line of U4 via the pulse forming network formed by capacitor C12 and resistor R22 to the Q1 output of latch U5. Having described the operation of anklet 18 including the manner in which the tamper bit number 31 of message M is both set and reset, remote station 17 will now be described in further detail.

Figure 6:
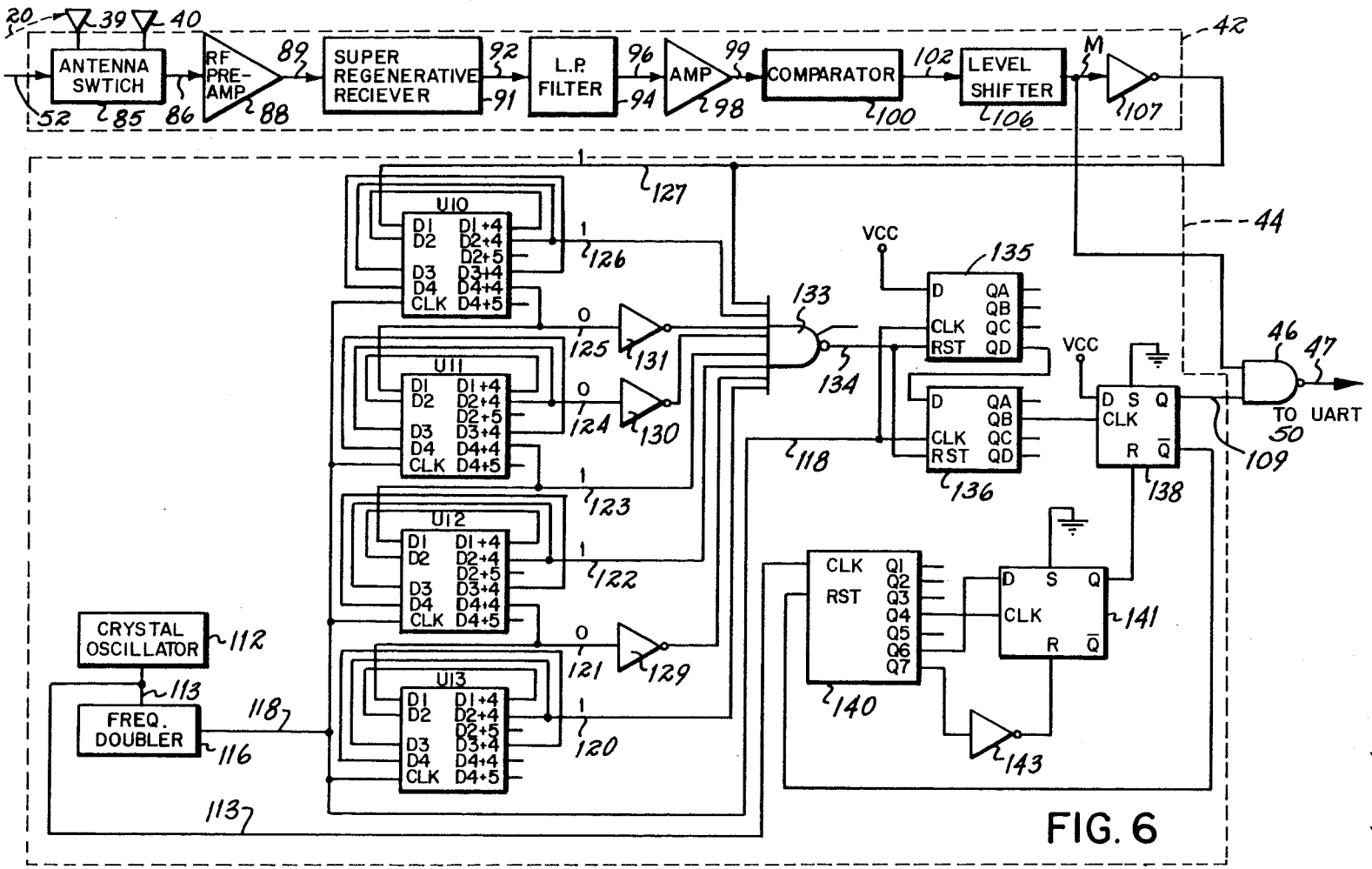
FIG. 6 is a combined electrical schematic and block diagram of the signal processor, preamble detector and gate shown in FIG. 1.

With additional reference now to FIG. 6, signal processor 42 includes an antenna switch 85 connected to antennas 39 and 40 only one of which is active at any given time. In the event that microprocessor 48 determines that a message M has not been received via telemetry 20, microprocessor 48 outputs an antenna switching signal 52 via line 52 to cause antenna switch 85 to activate the alternative antenna 39, 40 from that antenna 39, 40 which was previously active. As noted previously, this optional feature helps to avoid false absence indications due to irregularities in the reception patterns of antennas 39 and 40. Antenna switch 85 outputs an RF signal 86 to an RF preamp 88 to produce an amplified RF signal 89. A super-regenerative receiver 91 receives amplified RF signal 89 and demodulates it in conventional fashion to produce a demodulated analog signal 92 which is subjected to a low pass filter 94 to produce a filtered demodulated analog signal 96. Signal 96 is amplified via an amplifier 98 which feeds a comparator circuit 100. Comparator circuit 100 compares the signal 99 with predetermined high and low threshold levels to produce a digital signal 102 which is transformed into a logic level message signal M by a level shifter 106. An inverter 107 converts signal M to the logic polarities illustrated in FIG. 4.

Message signal M is applied to one input of NAND gate 46 the output of which in turn is applied to UART 50 which communicates with microprocessor 48 as described earlier with reference to FIG. 1. Message signal M is selectively gated to UART 50 via NAND gate 46 under the control of an enable signal 109 generated by preamble detector 44 in the manner which will now be described.

Preamble detector 44 includes a crystal oscillator 112 whose output 113 is matched in frequency to that of the crystal oscillator 85 associated with anklet 18. Signal 113 is applied to a frequency doubler 116 the output 118 of which is applied to the clock inputs of four shift registers U10, U11, U12 and U13 each of which may suitably comprise a 18 stage static shift register such as a type 4006 manufactured by Motorola Semiconductor Products, Inc. of Phoenix, Arizona or equivalent. Since signal 118 is twice the frequency of crystal oscillator 112 which itself operates at the same frequency as the crystal oscillator 85 associated with anklet 18 (FIG. 5) it can be appreciated that signal 118 has a period whose width is $\frac{1}{8}$ the length of each bit contained in message M. Shift registers U10, U11, U12 and U13 are serially connected so that 56 periods of signal 118 after bit #01 of the preamble of message M appears via signal 127 at pin D1 of shift register U10, preamble bits 01 through 07 will normally have been clocked through shift registers U10 through U13 so that preamble bit #,s 01 through 08 should appear at lines 120, 121, 122, 123, 124, 125, 126, 127, respectively. Provided the preamble signal comprises the arbitrary bit pattern described earlier with reference to FIG. 4, lines 120 through 127 will assume logical values of 1, 0, 1, 1, 0, 0, 1 and 1 respectively as shown where the preamble is received. To decode the preamble, lines 121, 124 and 125 are each subjected to an inversion by inverters 129, 130 and 131 respectively so that when the preamble 10110011 is present on lines 120 through 127, respectively, a logical one value will be applied to each input of a NAND gate 133. The output 133 of gate 134 is applied to the reset input of each of a pair of cascaded shift registers, 135 and 136 which may comprise a dual 4-stage static shift register such as type 4015 manufactured by Motorola Semiconductor Products, Inc. of Phoenix, Arizona or equivalent. Output pin QB of counter 136 is connected to the clock input of a D type flip flop 138 whose Q output provides enable signal 109 to gate 46. Counters 135 and 136 operate to insure that the valid preamble signal described with reference to FIG. 4 appears on lines 120 through 127 for six successive periods out of eight successive periods of signal 118 which is applied to the clock inputs of counters 135 and 136. Thus, enable signal 109 appears after a valid preamble is present on lines 120 through 127 for at least six successive periods of signal 118 out of eight such periods. Enable signal 109 then enables gate 46 to transmit to UART 50 that portion of message signal M following the preamble. In order to do so, signal 109 must be present for a sufficient length of time to permit transmission of the remaining bits of message M.

This is conveniently accomplished by means of a seven stage ripple carry binary counter/divider 140 as well as a D type flip flop 141 and an inverter 143 connected as shown. Counter/divider 140 may suitably comprise a type 4024 manufactured by Motorola Semiconductors Products Company, Inc. of Phoenix, Arizona. As illustrated in FIG. 6, the clock input of counter/divider 140 is connected to signal 113 while its reset line communicates with the $\overline{Q}$ out of flip flop 138. The Q4 output of counter/divider 140 is in turn connected to the clock input of flip flop 141 while Q6 of counter/divider 140 is connected to the D input of flip flop 141 and Q7 of the output of counter/divider 140 is connected by way of an inverter 143 to the reset line of flip flop 141.

In operation, the $\overline{Q}$ output of flip-flop 138 will remain at a logic low level to keep counter/divider 140 continuously reset until shift registers 135 and 136 activate the clock input to flip-flop 138 thereby indicating that a valid preamble signal has been present for at least six successive periods of signal 118. At that time, $\overline{Q}$ of flip-flop 138 goes low to permit counter/divider 140 to commence counting cycles of signal 113. After one hundred and four successive cycles of signal 113 have been counted, the Q4, Q6 and Q7 outputs of counter/divider 140 cause the Q output of flip flop 141 to go high thereby resetting flip flop 138 and disabling gate 46 whose output 47 is input to UART 50.

Figure 7:
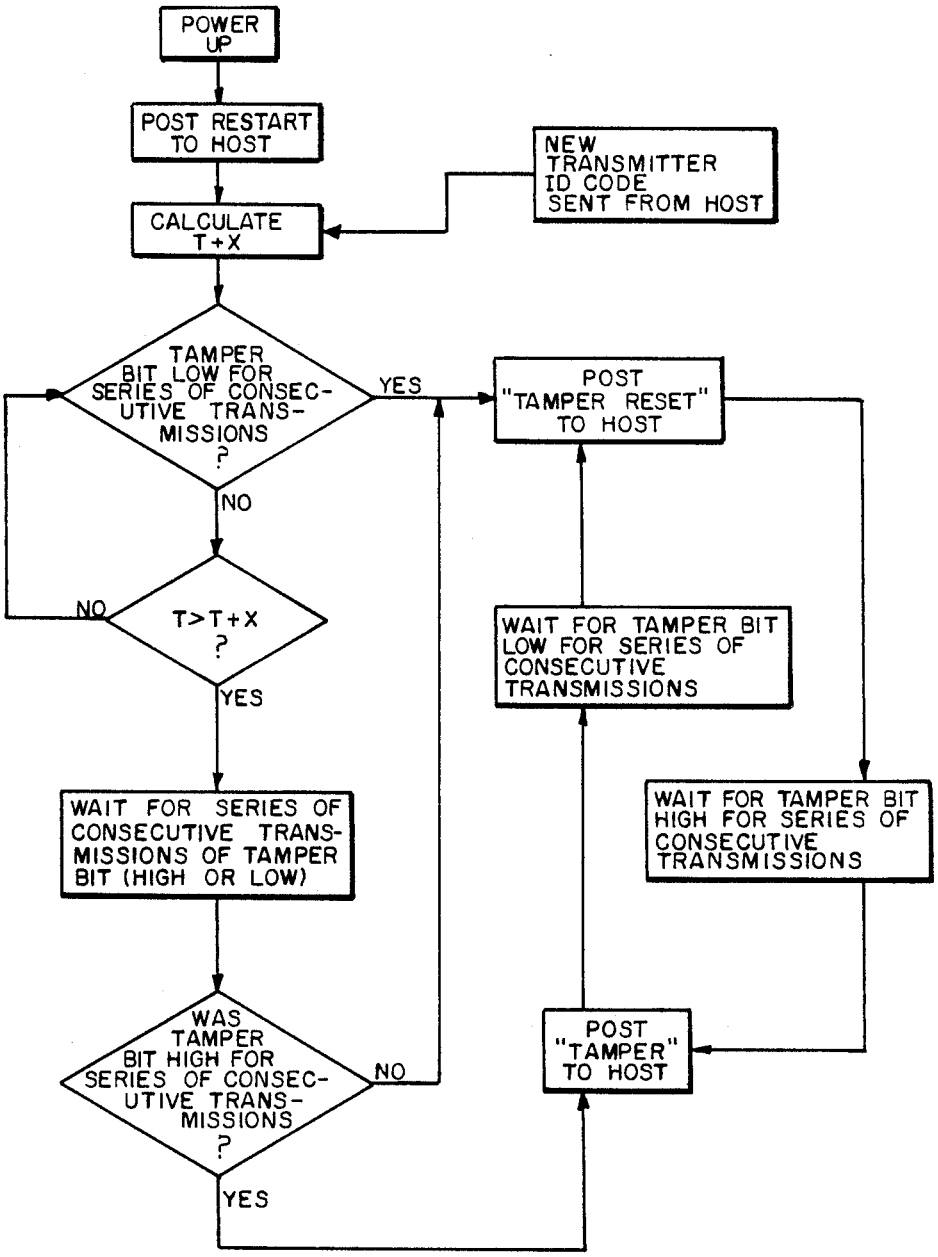
FIG. 7 is a software flow chart illustrating how the microprocessor of FIG. 1 is programmed to monitor and communicate the status of the tamper signal included in the telemetry of FIG. 4.

With further reference to FIG. 1, it can be seen that message information is transmitted through gate 46 along line 47 to UART 50 for presentation to microprocessor 48. UART 50 serves to break the information appearing on line 47 down into a series of multi bit bytes which can conveniently be accessed by microprocessor 48. The operation of microprocessor 48 may be more completely understood with reference to commonly assigned U.S. Pat. Application Ser. No. Ser. No. 07/343,860 entitled Remote Confinement System filed in the names of Williamson et al. on even date herewith and previously incorporated herein by reference in its entirety. For purposes of understanding the present invention, it is necessary only to consider the manner in which microprocessor 48 operates in regard to changes in the status of the TAMPER bit, bit #31 of message M as will now be described with additional reference to FIG. 7.

After remote station 17 is initially powered up upon installation, microprocessor 48 posts a restart message to the host computer at central monitoring station 23 via modem 32, telephone line 27, telephone switching network 24 and telephone line 29. The restart message includes an identification number unique to a particular remote monitoring station 17, the time of day and a restart code. Upon receipt of the restart message, the host computer at central monitoring station 23 transmits to microprocessor 48 the correct time of day, T whereupon microprocessor 48 calculates a time a number of hours, X, later than the current time for a purpose to be explained shortly. The same calculation is initiated in the event the central monitoring station transmits to microprocessor 48 instructions to recognize a new transmitter identification code. X is selected to be an interval longer than the interval at which the TAMPER bit transmitted by anklet 18 is automatically reset. For example, as described above, TAMPER bit #31 is automatically reset approximately every 18 hours. Accordingly, time interval X may suitably comprise an interval somewhat longer, such as 21 hours.

Microprocessor 48 then tests to determine whether TAMPER bit #31 of message M has been low indicating that the TAMPER bit has previously been reset for a series of consecutive transmissions from anklet 18. If so, microprocessor 48 posts a "TAMPER RESET" message to the host computer at central monitoring station 23 to advise the central monitoring station that the TAMPER bit has been reset and that normal tamper monitoring has commenced. If the TAMPER bit is not low for said series of consecutive transmissions from anklet 18, microprocessor 48 tests to determine whether the current time, T, is past the previously calculated time T+X. If time T +X has not passed, microprocessor 48 continues to wait for the tamper bit to appear low for a series of consecutive transmissions. Once the current time, T, exceeds the calculated time limit T+X, microprocessor 48 waits for the status of TAMPER bit #31 to stabilize by awaiting a series of (e.g., seven) consecutive transmissions wherein the TAMPER bit remains either high or low. This serves to verify that the tamper indication is valid.

If the tamper bit was high for that consecutive series of transmissions, indicating that an actual tamper condition occurred after the time period during which the TAMPER bit transmitted by anklet 18 should certainly have been reset by signal 150, microprocessor 48 informs central monitoring station 23 by posting a "TAMPER" message to the host computer residing there by sending such message via modem 32, telephone line 27, telephone switching network 24 and telephone line 29.

If the TAMPER bit was not high for a predetermined series of consecutive transmissions, microprocessor 48 responds by posting a "TAMPER RESET" message to the host at central monitoring station 23 in the manner described earlier. In such event, microprocessor 48 continues to wait for the occurrence of tampering as indicated by the TAMPER bit remaining high for a series of consecutive transmissions. If such a tamper indication is received, microprocessor 48 posts the "TAMPER" message to central monitoring station 23 in the manner just described. In this way, the system avoids posting a "TAMPER" message to central station 23 for the period of time X following either the initial power up of the remote station or the transmission of a new transmitter identification code to be recognized by microprocessor 48 since at least one "false" tamper indication may be generated by either of those events. Yet, because signal 150 will have been generated prior to the passing of time T+X any tamper indications received thereafter are presumed valid and will be forwarded to the central monitoring station 23. Once a "TAMPER" message has been posted, it remains posted until a reliable indication that TAMPER bit #31 has been reset is received by microprocessor 48. This is accomplished by waiting for the TAMPER bit to assume a logical low value for a predetermined series of consecutive transmissions whereupon a "TAMPER RESET" message is then posted to central monitoring station 23.

In operation, assuming that TAMPER bit #31 is initially reset to a low logic level so that no tamper indication previously was present, breakage of strap 19 due to tampering will set the Q1 output of latch U5 thereby initializing counter U4 to commence timing of a new reset interval as well as causing TAMPER bit #31 of message M to change logic states indicating the occurrence of a tamper event. By way of example, the reset interval may conveniently be set at about eighteen hours.

Provided at least a second interval which is longer than the first interval (e.g., 21 hours) has elapsed since either power was applied to remote station 17 or remote station 17 received any instruction to begin recognizing a new transmitter identification code, remote station 17 will relay to central monitoring station 23 information in the form of a "TAMPER" message indicating that tampering has occurred. Otherwise, remote location 17 will inhibit transmission of the "TAMPER" message to central monitoring station 23 until the second interval has expired. By that time, the 18 hour period determined by counter U4 will have expired thereby generating a tamper reset signal 150. Provided reset signal 150 is generated after strap 19 has been replaced or repaired to restore its electrical continuity, the Q1 output of latch U5 will reset thereby restoring TAMPER bit #31 to its previous non-tamper indication. Information containing a "TAMPER RESET" message will then be transmitted to central monitoring station 23.

On the other hand, if strap 19 has not been repaired or replaced by the time reset signal 150 is generated, TAMPER bit #31 will set itself again almost immediately after the brief reset signal 150 disappears so that the tamper indication will persist until strap 19 is serviced and the next reset signal 150 is generated.

Assuming confinee 16 is permitted to leave confinement area 12 for some time each day such as a nine hour period and further assuming that the confinee cuts strap 19 at the beginning of such period after leaving area 12, the tamper condition will still be detected even though it occurs while transmitter 15 is out of range for communication with remote station 17. When strap 19 is cut, TAMPER bit #31 of message M would indicate the tamper condition and counter U4 would begin timing a new 18 hour period. At the conclusion of the nine hour absence, the confinee would be required to return to area 12 whereupon the status of TAMPER bit #31 would promptly be detected by remote station 17 and a "TAMPER" message would be posted to central monitoring station 23. In the present example, that tamper indication would persist for at least an additional nine hours until U4 generated the next reset signal 150. Provided strap 19 had been repaired by that time, TAMPER bit #31 would be reset, resulting in posting of a "TAMPER RESET" message to central station 23.

In light of the present disclosure, those skilled in the art will recognize that various changes can be made to the structure and/or operation of the embodiment described herein or other embodiments constructed which, although different in certain respects from the embodiment described, still fall within the scope of the present invention as particularly pointed out and distinctly claimed in the appended claims.

What is claimed is:

1. A remote confinement system, comprising:
(a) a transmitter intended to be worn on the body of a confinee for transmitting a message which includes a tamper signal activated in response to a tamper event;
(b) a remote station located within a confinement area the boundary of which is defined by the range of communication between said remote station and said transmitter, said remote station including a receiver for receiving said message when said transmitter is located within said confinement area, and
(c) reset means for resetting said tamper signal in response to the elapsing of a first interval of time after said tamper signal is activated, said tamper signal remaining reset until being activated in response to a subsequent tamper event.

2. The system of claim 1 wherein said first interval of time is selected to be longer than any continuous period said confinee is permitted to be absent from said confinement area.

3. The system of claim 1 further comprising:
(a) a central monitoring station connectable to said remote station via a communication link;
(b) means for transmitting from said remote station to said central monitoring station information related to the status of said tamper signal to permit monitoring of said information at said central monitoring station, and
(c) means for inhibiting transmission of said information from said remote station to said central monitoring station in the event:
(i) said information indicates the occurrence of a tamper event, and
(ii) less than a second interval of time has elapsed since the occurrence of a predetermined event, said second interval of time being greater than said first interval of time.

4. The system of claim 3 wherein said predetermined event comprises the initial application of power to a component of said remote station.

5. The system of claim 3 wherein said message further includes an identification code recognizable by said remote station and wherein said predetermined event comprises receipt by said remote station of an instruction to change the identification code recognized by said remote station.

6. The system of claim 1 wherein said reset means comprises a timer.

7. The system of claim 1 wherein said reset means comprises a counter.

8. The system of claim 1 wherein said tamper event comprises removal of said transmitter from the body of said confinee.

9. The system of claim 1 wherein said tamper event comprises interrupting the continuity of a member serving to secure said transmitter to the body of said confinee.

10. The system of claim 1 wherein said message is correlated to a multi-bit message at least one bit of which contains information correlated to said tamper signal.

11. The system of claim 6 further comprising timer initialization means coupled to said timer for initializing said timer in response to the occurrence of said tamper event to ensure that said tamper signal is not reset in less than a predetermined time period after said tamper event.

12. The system of claim 7 further comprising counter initialization means coupled to said counter for initializing said counter in response to the occurrence of said tamper event to ensure that said tamper signal is not reset in less than a predetermined time period after said tamper event.

13. A remote confinement system, comprising:
(a) a transmitter intended to be worn on the body of a confinee for transmitting a message which includes a tamper signal which is activated in response to a tamper event;
(b) a central monitoring station for monitoring the status of said tamper signal as well as the presence of said confinee within a confinement area;
(c) a remote station located within said remote confinement area, said remote station being connected to said central monitoring station by way of a communication link, said remote station including a receiver for receiving said message when said transmitter is present within said remote confinement area to transmit to said central monitoring station information indicating the presence of said confinee therein as well as the status of said tamper signal, and (d) reset means for resetting said tamper signal in response to the elapsing of a predetermined interval of time after said tamper signal is activated, said tamper signal remaining reset until being activated in response to a subsequent tamper event.

14. The system of claim 13 wherein said interval of time is selected to be longer than any continuous period said confinee is permitted to be absent from said confinement area.

15. The system of claim 13 further comprising means for inhibiting transmission to said central monitoring station information indicating that a tamper event has occurred if less than a second interval of time has elapsed since the occurrence of a predetermined event.

16. The system of claim 15 wherein said predetermined event comprises the initial application of power to a component of said remote station.

17. The system of claim 15 wherein said message further includes an identification code recognizable by said remote station and wherein said predetermined event comprises receipt by said remote station of an instruction to change the identification code recognized by said remote station.

18. A tamper indicating apparatus for transmitting a message indicative of the proximity of a confinee to a receiver, said apparatus comprising:

(a) a transmitter for transmitting said message;

(b) securing means for securing said transmitter to the person of the confinee;

(c) tamper detection means for detecting tampering with at least one of, said transmitter and said securing means, said tamper detection means being coupled to said transmitter to effect a predetermined change in said message, said change being indicative of said tampering and persisting at least until a rest signal is applied to said tamper detection means, and (d) reset means for generating said reset signal in response to the elapsing of an interval of time after tampering has occurred, said message remaining reset until being activated in response to a subsequent tampering.

19. The apparatus of claim 18 wherein said interval of time is longer than any continuous period said confinee is permitted to be absent from a confinement area.

20. The apparatus of claim 18 further comprising:

initialization means coupled to said reset means for initializing said reset means in response to the occurrence of tampering to ensure that said change persists for at least a predetermined time period after tampering has occurred.

* * * * *

UNITED STATES PATENT AND TRADEMARK OFFICE

CERTIFICATE OF CORRECTION

PATENT NO. : 4,980,671

DATED : December 25, 1990

INVENTOR(S) : Jim A. McCurdy

It is certified that error appears in the above-identified patent and that said Letters Patent is hereby corrected as shown below:

Col. 10, line 31, "#,s" should be --#'s--.

Col. 16, line 15, "rest" should be --reset--.

Signed and Sealed this

Eighth Day of December, 1992

*Attest:*

DOUGLAS B. COMER

*Attesting Officer*

*Acting Commissioner of Patents and Trademarks*